United States Patent [19]

Bakke

[11] 3,991,519

[45] Nov. 16, 1976

[54] WINDOW CONSTRUCTIONS

[75] Inventor: Bjørn Bakke, Bergen, Norway

[73] Assignee: A. Knag. A/S., Bergen, Norway

[22] Filed: Jan. 2, 1975

[21] Appl. No.: 537,902

[30] Foreign Application Priority Data

Mar. 18, 1974 Norway ..... 740944/74

[52] U.S. Cl. ..... 49/159; 49/260

[51] Int. Cl.[2] ..... E06B 11/00

[58] Field of Search ..... 49/158, 159, 160, 168, 49/254, 153, 258, 259, 176, 183, 187, 152, 154, 155, 260, 485

[56] References Cited

UNITED STATES PATENTS

| | | | |
|---|---|---|---|
| 1,961,327 | 6/1934 | Barth | 49/158 |
| 3,041,680 | 7/1962 | Gurniak | 49/152 |
| 3,429,070 | 2/1969 | Hurst | 49/158 |
| 3,641,705 | 2/1972 | Schmidlin | 49/256 |
| 3,775,905 | 12/1973 | Frank | 49/176 X |

*Primary Examiner*—Philip C. Kannan
*Attorney, Agent, or Firm*—Bidyut K. Niyogi

[57] ABSTRACT

A window construction has at least two window- and-/or wall-forming sections mounted in series on a common, stationary top profile member of which at least one first type of section is pivotably suspended about an upper horizontal axis for swinging from a closed position to an airing position and vice-versa and a second type of section is either similarly pivotably suspended or stationarily mounted on said member. The top profile member has two separate grooves, one for each of the types of section, which enables the first type of section to be also longitudinally displaceable relative to the section of the second type and independently of any remaining sections. Each section forms exclusively on the inwardly directed side thereof a sealing abutment against its respective stationary packing arrangement. The packing arrangement for the first type of section is arranged approximately flush with the outwardly directed side of the second type of section.

9 Claims, 6 Drawing Figures

Figure 1:
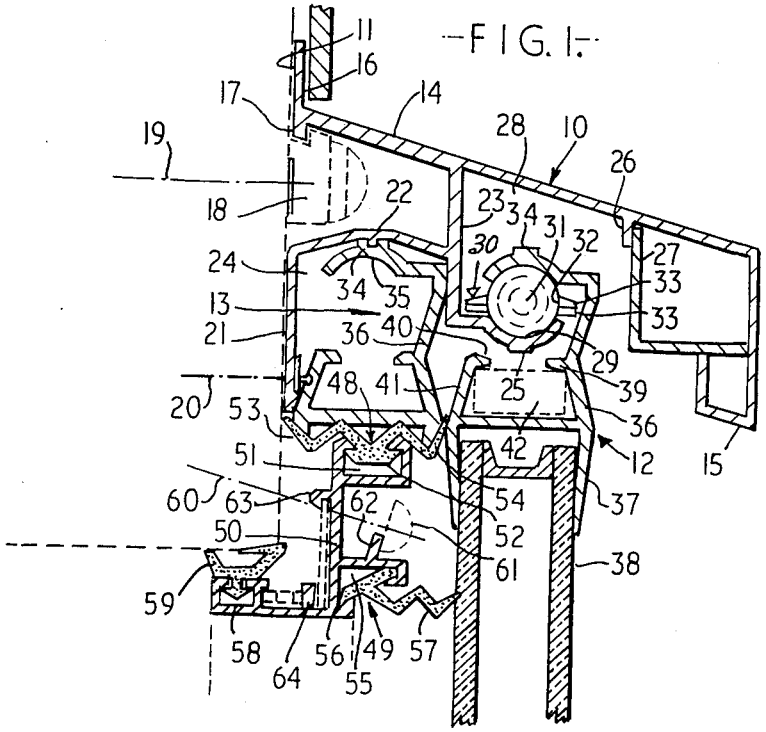

11
16
17
14
28
10
26
19
18
22
23
34
31
32
27
24
30
33
13
34
35
33
21
36
40
29
20
48
41
25
39
53
36
42
12
15
51
60
63
62
54
37
50
52
61
38
59
58
64
56
49
57
55

70
69d
65
69b
68
66
38
12
67
49
71
37
43
48
45
13
4
46

-FIG. 3-
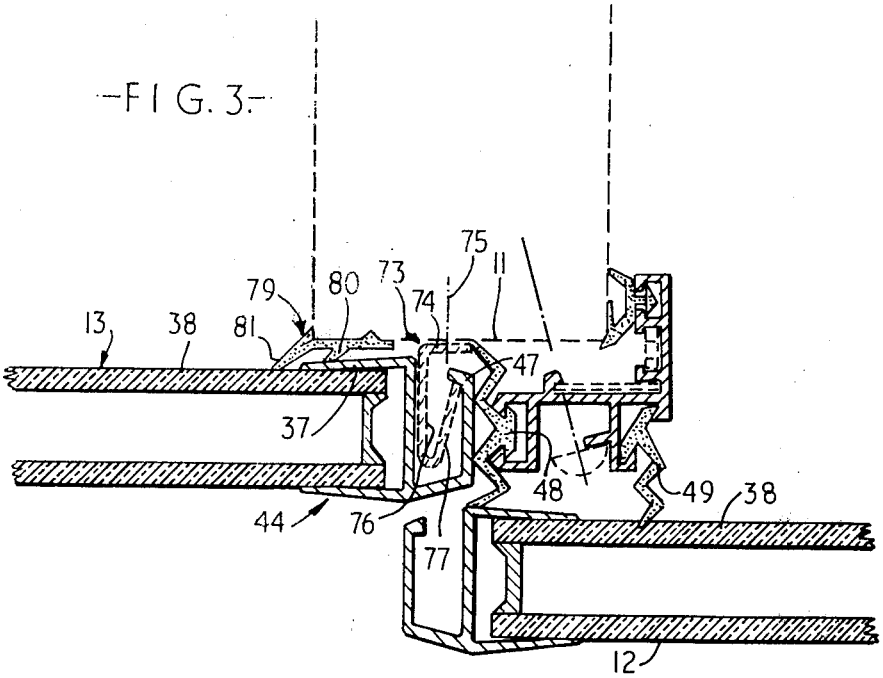
-FIG. 4-
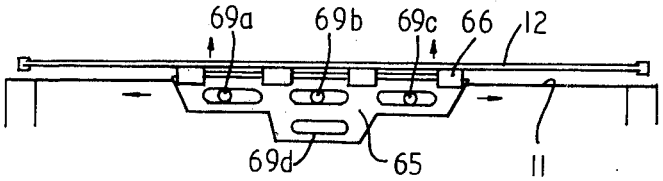

-FIG. 5-
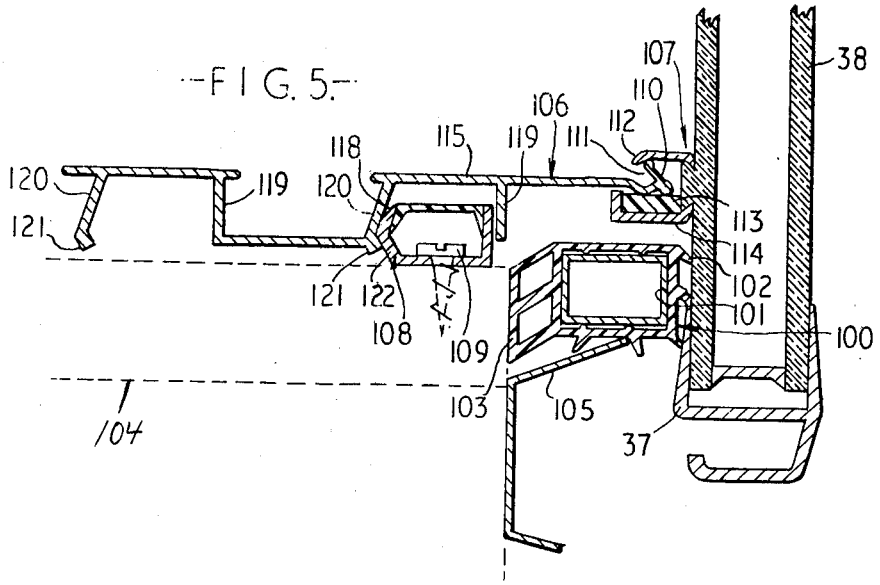
-FIG. 6-
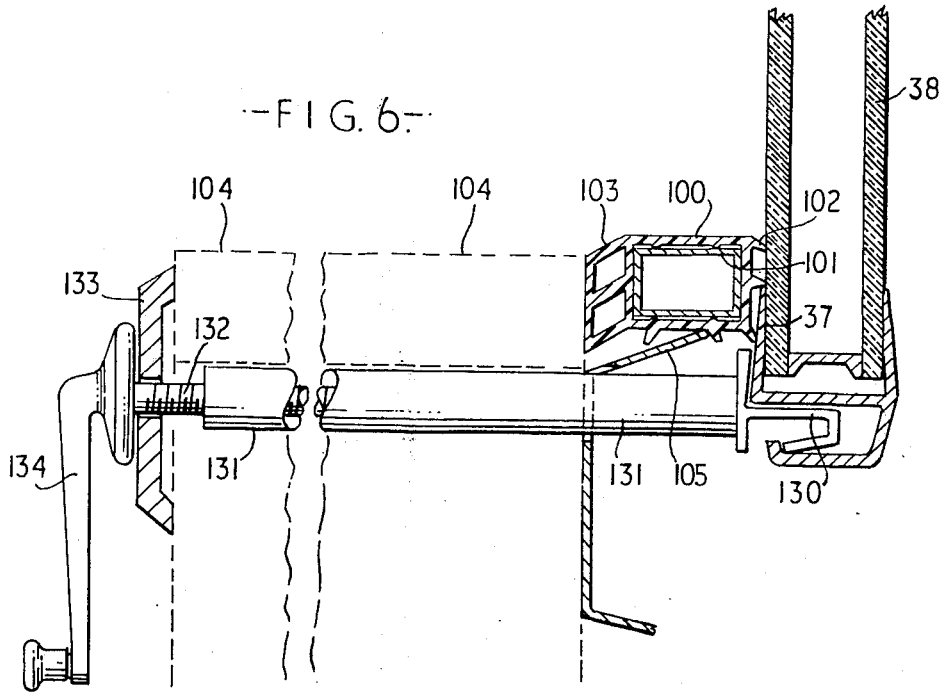

WINDOW CONSTRUCTIONS

This invention relates to window constructions comprising two or more window-forming and/or wall-forming sections which are mounted in series on a common, stationary top profile member.

When sections are referred to in the following description, whether the sections are window-forming or wall-forming is arbitrary, that is to say the sections can as required be provided with more or less transparent window glass or with wall-forming panels of dull or coloured glass or of another suitable material.

In Norwegian patent specification No. 107,161, there is proposed a wall arrangement consisting of a series of sections which are swingably mounted in a common, stationary top profile about an upper horizontal axis, so that the sections can be pivoted from a closed position with sealing abutment against a frame-forming portion to a swung-out position. The sections are adapted in the said swung-out position to be displaceable longitudinally in the common top profile in one and the same groove. In order to obtain a vertical opening between two of the sections, for example in order to obtain a vertical air column between the sections or in order to obtain admission to the outer sides of the various sections for the purpose of cleaning and the like, it is necessary to displace a whole series of sections simultaneously or different sections in turn and order. Such a solution where one is dependent upon displacing two or more sections in order to obtain an opening between the sections is rather cumbersome with large series of sections, for example with office structures, but it can also be clumsy even with smaller series of sections if the sections are disposed connected to different spaces lying within. The known construction finds its largest employment in industrial construction, but on the other hand is less satisfactory for office construction, dwelling houses and the like.

With the present invention the aim is a solution in which the window construction can be employed in industrial construction as well as in office construction and dwelling houses. A special goal is to provide vertical openings between certain sections and the adjacent sections without having to displace the adjacent sections, and at the same time the aim is an effective sealing off of each individual section.

According to the present invention a window construction comprises at least two window- and/or wall-forming sections mounted in series on a common, stationary top profile member of which at least one first type of section is pivotably suspended about an upper horizontal axis for swinging from a closed position to an airing position and vice-versa and a second type of section is either similarly pivotably suspended or stationarily mounted on said member which is provided with first and second grooves for the first and second types of section respectively enabling the first type of section to be also longitudinally displaceable relative to the second type of section independently of any remaining sections, each section forming exclusively on the inwardly directed side thereof a sealing abutment against its respective stationary packing arrangement and the packing arrangement for the first type of section being arranged approximately flush with the outwardly directed side of the second type of section.

Figure 2:
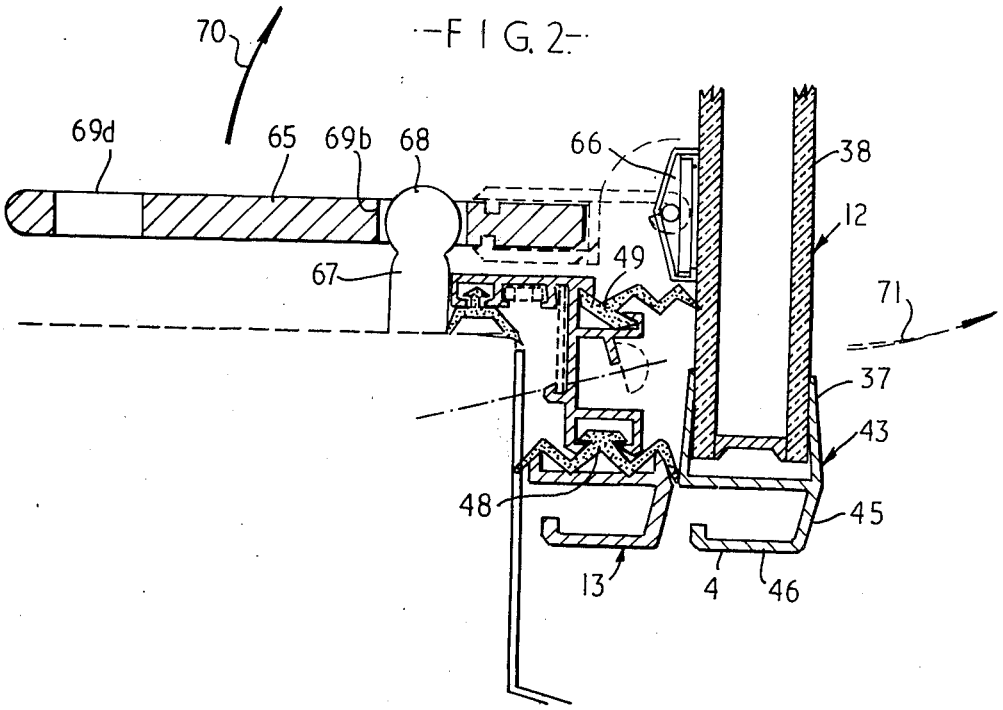

In order that the invention can be more clearly understood, convenient embodiments thereof will now be described, by way of example, with reference to the accompanying drawings in which:

FIG. 1 is a vertical section of part of an upper portion of a window construction according to the invention, FIG. 2 is a vertical section of part of the lower portion of the window construction of FIG. 1, FIG. 3 is a horizontal section of part of the first and the second types of section of the window construction of FIG. 1, FIG. 4 illustrates a detail of a pivotable section of the same window construction, FIG. 5 is a vertical section of part of an alternative construction of the lower portion of the window construction, and FIG. 6 is a vertical section of part of another alternative construction of the lower portion of the window construction.

Referring to FIG. 1, a top profile member 10 extends longitudinally along a house wall 11 for the reception of several sections 12, 13 in series. There are only shown two sections 12, 13, that is to say a first type of section 12 which is received longitudinally displaceable and pivotable about a horizontal axis and a second type of section 13 which is stationarily fixed. The second type of section 13 can, if desired, be correspondingly pivotable as the first type of section 12, but on the other hand is not displaceable longitudinally. The sections 12 and 13 are, however, of identical design so that, as required and all according to where they are disposed in the profile member 10, they can be employed as the first or the second type of section.

The profile member 10 is designed with a top plate 14 extending slopingly downwards and outwards which in front is terminated with a dripping nose-forming front portion 15 having an inwardly bent, substantially J-shaped crosssection and which at the rear is terminated by an upwardly extending support flange 16 and a downwardly extending locking flap 17 which serves to engage with a locking means 18 which is fixed by screws to the house wall. On mounting, the profile member 10 is hooked into position on the locking means 18 by a suitable displacement of the profile member relative to the locking means and thereafter the profile member 10 is secured to the house wall by means of further fixing screws 20 through a lower support member 21. The support member 21 is connected, via a horizontal web portion 22, to a vertical web portion 23, the upper end of which is connected to the under side of the top plate 14. The locking means 18 is received in the intermediate space between the top plate 14 and the web portions 22 and 23. Between the lower support member 21, the web portion 22 and a lower part of the web portion 23, there is formed a groove 24 for the reception of the section 13 in a stationarily fixed manner. Between the top plate 14, the web portion 23, a support flange-forming extension 25 of the web portion 23 and a flap 26 directed downwards from the top plate 14 together with a support means 27 which is pushed in between the flap 26 and the front portion 15, there is formed a groove 28 for the pivotable, longitudinally displaceable section 12. On insertion and withdrawal of the section 12 from the groove 28 of the profile member, the support means 27 is removed. The support flange-forming extension 25 is designed with a concavely rounded upper surface to form a grooved guide 29 for a roller rail 30 having associated roller-forming balls 31. The balls are received with suitable intermediate spaces in cavities 32 in two oppositely curved, bearing-forming borders 33 which are joined together along impacting edges. Towards the top of the balls 31 rests the section 12 by way of an upper support portion 34 designed with a guide 35 which corresponds to the guide 29. As is evident from FIG. 1, the support portion 34 is adapted to be pivoted 15°–20° relative to the rail 30 without coming into conflict with the latter. The support portion 34 is connected by way of an outer web portion 36 with an upper, outer corner of an inverted U-shaped frame portion 37 which embraces the upper edge of a double pane 38 to form an approximately profile cross-section. The web portion 36 is bent inwards concavely at the central portion and at a distance below the central portion is provided with a first flap portion 39 which is arranged directly opposite a second flap portion 40 at the upper end of an oblique, upwardly extending inner web portion 41. In the space between the flap portions 39, 40 and the web portions 36, 41, there is received a panel channel filler 42.

The upper frame portion of the sections 12, 13 is designed with a first type of profile as is evident from FIG. 1, while the lower, horizontal frame portion 43 (FIG. 2) of the sections and the two opposite vertical frame portions 44 (see FIG. 3) are designed with another type of profile. The frame portions 43 and 44 of the second type of profile are provided with a U-shaped frame portion 37 corresponding to the frame portion 37 of the first type of profile, but the support portion 34, the flap portions 39, 40 and the web portions 36, 41 are provided instead with an outwardly projecting profile portion having a substantially J-shaped cross-section, that is to say with a first web portion 45 extending obliquely outwards from the U shape which passes over into a second transverse web portion 46 which is terminated by a flap portion 47 extending rearwardly towards the U shape.

The first section 12 is disposed parallel to the second section 13 in the closed position illustrated in FIG. 1–3 and quite closely up to the latter without being in direct contact with the second section. In the closed position, the section 12 forms a sealing abutment against two concentric rectangular gaskets 48, 49 in a common, annular holder 50 which form stationary, internal frame terminations against the section 12. The holder 50 has an approximately L-shaped profile. At one leg end of the L shape, there is formed a groove 51 for the reception of a head 52 of the gasket 48, while from the head the gasket extends outwards in opposite directions with gasket flaps 53, 54 of zigzagged cross-section. The one flap 53 forms an abutment directly against the outer wall 11 while the opposite flap 54 forms an abutment against the frame portion 37 or the web portion 41. At the corner of the L shape, there is formed a groove 55 for the reception of a head 56 of the gasket 49 while from the head, the gasket extends outwards with a flap portion 57 of zigzagged cross-section. The flap portion 57 forms a sealing abutment directly against the pane 38. At the opposite leg end of the L shape, there is formed a groove 58 for the reception of a head of a double-flapped gasket 59 which forms a seal between the holder 50 and the horizontal window frame portion of the outer wall. It is evident that the holder 50 is protected from the outside air by means of the outer gasket 48, so that condensation on the holder is avoided. Correspondingly, condensation is prevented on the frame of the section due to the gasket 49 forming an abutment against the section within the frame. The holder is secured to the wall by screws 60, the heads 61 of which form a support abutment against a flap 62 on the outer side of the holder. At 63 and 64 there are shown internal fastening flaps. As shown in FIG. 2, the section 12 is clamped against the gaskets 48, 49 by means of a tensioning means 65 (see also FIG. 4) which is permanently welded or secured in another manner to a mounting forming a pivot bearing on the pane. The mounting means 65 cooperates with a locking means 67 fixed to the holder 50 or the section frame itself by virtue of a head 68 on the locking means projecting upwards into a correspondingly shaped groove **69*b* in the tensioning means 65. The tensioning means is provided with three successive grooves 69*a*, 69*b*, 69*c* as shown in FIG. 4 so as to be able to clamp the section 12 in various particular positions relative to the section frame. At 69*d* there is shown a groove designed for clamping the section in an outwardly swung position. On swinging the tensioning means 65 upwards in the direction of the arrow 70, the tensioning means is freed from the locking means 67 and the section 12 can be swung outwardly at the lower part (pivoting about a horizontal axis at the top about the pivot bearing which is formed by the balls 31 in the rail 30) as indicated by the arrow 71 in FIG. 2. The section 12 is now released for longitudinal displacement to a desired new position in the one or the other direction. The new position is established by reception of the locking means 67 in one of the associated grooves 69*a* or 69*c*, so as to limit thereby an opening between the sections on the left or the right side of the section as required, for example dependent on the direction of the wind. Also in the new position the gaskets 48, 49 form a seal against the section. On cleaning the sections adjoining section 12 the tensioning means 65 can, instead of being secured at particular positions relative to the locking means 67, be swung downwards along the section 12 or if desired upwards along the section so that the section can be displaced freely to arbitrary positions without the necessity of sealing the gaskets 48, 49.**

The section 13, which in the illustrated embodiment is stationarily clamped, is closed off at the top in groove 24 of the profile member 10, the support flange 34 and the upper part of the web portion 36 forming support abutments against horizontal web portion 22 and vertical web portion 23 of the profile member 10 respectively. At the remaining edges of the section the frame members of the section are fixed in position on the outer wall by means of a catch-forming clamp means 73 which is received in the hollow space in the J-shaped profile portion 45–47. The clamp means 73 is secured, via a first flange 74, with screws 75 to the outer wall while a web portion 76 forms lateral supports for U-shaped portion 37 of the frame portions 43 and 44 respectively and an outer flap 77 with its outer edge forms a support abutment against the flap portion 47. If the section 13 is to be pivotable correspondingly to the section 12, it is self-evident that the clamp means 73 is superfluous since the section 13 is suspended in a corresponding manner to the section 12 on a support flange (not shown) of the profile member 10 suitable for that purpose and clamped with a suitable tensioning means. The section 13 forms, on the inner side, an abutment against a gasket 79 which is secured to the outer wall as shown in FIG. 3. The gasket is provided with a first flap 80 which forms an abutment against the frame portion 37 and with a second flap 81 which forms an abutment directly against the pane 38 within the frame portion.

It is possible to arrange the sections 12 and 13 in series employing an arbitrary number in which, for example, every other section is of the first type and the intermediate section is of the second type. Alternatively, there can be utilised, for example, in series one or two sections of the second type and thereafter one or two sections of the first type etc.

In FIG. 5, the gasket 49 of FIG. 2 is replaced by a gasket 100 which surrounds and is supported by a holder 101 of rectangular pipe. The gasket forms, on the one side, an abutment against the window pane 38 and the frame portion 37 with sealing flaps 102 and, on the opposite side, forms with the aid of an elastically yielding duct-containing sealing portion 103, an abutment against a frame plate 104. The gasket 100 forms a support abutment against the upper end of a support profile 105 which is fixed to the wall just below the frame plate 104.

The tensioning means 65, the mounting 66 and the locking means 67 of FIGS. 2 and 4 is replaced by three cooperating profile members 106, 107 and 108. A first profile member 106 which forms a tensioning means, is relatively narrow and is adapted to be adjustable in different positions along the profile members 107 and 108. The profile member 107, which forms a mounting fixed to the window pane, extends the whole of the length of the window so that the tensioning means 106 can be clamped to the profile member 107 in different longitudinally displaced positions of the window section 12 relative to the frame. Correspondingly, the profile member 108, which forms a locking means for the tensioning means 106 and which is fixed to the frame plate 104 by screws 109, extends the whole of the length of the frame plate 104 so that the window section 12 can, as desired, be displaced to the left or the right relative to the frame with corresponding clamping possibilities between the window section and frame via the profile members 106–108.

The profile member 106 is provided at the one end with a head 110 with a cavity 111 which cooperates with a support flap 112 of the profile member 107, while the head 110 forms a support abutment against a rubber strip 113 on a support flange 114. The rubber strip ensures a sliding abutment between the head 110 and the support flap, at the same time as it prevents an intentional lateral displacement of the head 110 along the profile member 107. On swinging the tensioning means 106 and, from the position shown in FIG. 5, 90° upwards about the head 110, the support flap 112 can be received in the cavity 111 and the head 110 can be released from the rubber strip 113 and can be freely displaced to desired positions along the mounting-forming profile member 107.

The profile member 106 is provided with two downwardly directed channel portions 115 and 116 having corresponding profile cross-sections which are adapted to be engaged with a snapping effect outside the upwardly directed channel legs 117, 118 of the profile member 108. The channel portions 115 and 116 are provided with a first vertical leg 119 which forms a sliding abutment against a corresponding vertical side of the channel leg 117 and are provided with a second leg 120 having a rearwardly extending flap portion 121 which is adapted to be snapped in below a shoulder-forming projection 122 on the other channel leg 118. The first channel portion 115 is adapted, as shown in FIG. 5, to form a locking head for the locking means 108 in the closed position of the window section 12, while the channel portion 116 is correspondingly adapted to form a locking head for the locking means 108 in an outwardly swung airing position of the window section 12.

In FIG. 6, there is illustrated a third construction of the lower portion of the window construction in which the mounting on the window pane is replaced by a mounting 130 which engages the frame profile of the window. The mounting 130 is fixed to an internally threaded sleeve 131 which passes through the wall and which engages an externally threaded screw 132 which is rotatably mounted in a fastening plate 133 on the inner side of the wall. To the screw there is fixed a handle 134.

On closing the window section 12, the window section 12 is cranked into sealing abutment against the gasket 100. In such a position the window section will be prevented from being swung about the upper pivotal axis of the window section, but at the same time will also be prevented as a consequence of the friction against the gasket 100 from moving longitudinally relative to the window frame. By cranking out again, the window section can be released from the gasket 100 and displaced longitudinally relative to the gasket 100 as well as to the mounting 130 which can slide unhindered in the frame profile. On further cranking out, the window construction can be pivoted further about the upper pivotal axis and can be adjusted to the desired airing positions.

What we claim is:

1. In a window construction comprising at least two sections constituted by a window section and a wall section and a common, stationary top profile member having said sections mounted in series thereon of which at least one first type of section is pivotably suspended about an upper horizontal axis for swinging from a closed position to an airing position and a second type of section is stationarily mounted on said member, in which said top profile member is provided with first and second grooves for the first and the second types of section respectively enabling the first type of section to be also longitudinally displaceable relative to the second type of section independently of any remaining sections, each section having its respective stationary packing arrangement and forming exclusively on the inwardly directed side thereof a sealing abutment against said packing arrangement and the packing arrangement for the first type of section being arranged approximately flush with the outwardly directed side of the second type of section.

2. A construction according to claim 1, wherein the first and second types of section are identical permitting the interchangeable use thereof.

3. A construction according to claim 1, wherein the first and second types of section are each provided with a frame which is approximately Y-shaped in section, an approximately U-shaped portion thereof serving to receive at least one such section and an approximately J-shaped portion connected to said U-shaped portion forming a section support portion for displacement and pivoting of the section at the upper end thereof and in the case where the second type of section is stationary forming a stop means at least at one part of the construction, in which the stop means is constituted by a part of the vertical side and also by a lower end of the section for a clamp means adapted to be fixed to an outer wall.

4. A construction according to claim 1, wherein the packing arrangement for the at least one first type of section comprises inner and outer concentric annular gaskets.

5. A construction according to claim 4, wherein a holder has the gaskets mounted thereon and is adapted to be fixed to a vertical window frame portion of an outer wall as well as sealingly engaged to a horizontal window frame portion thereof, pivotable tensioning means sealingly clamping a lower frame portion of the first type of section against said gaskets, said tensioning means being adapted to be locked so as to permit such clamping of the section in different positions relative to the section frame and to be released so as to permit the lower part of said section to be swung outwardly and the section thereby released for longitudinal displacement in at least one direction to a position in which relocking of the tensioning means limits an opening between the sections of the first and second types and reestablishes sealing engagement between the gaskets and the first type of section.

6. A construction according to claim 5, wherein a mounting on at least one said section has the tensioning means secured thereto and forms a pivot bearing for said tensioning means.

7. A construction according to claim 1, wherein the packing arrangement for at least one first type of section comprises a gasket which surrounds and is supported by a holder of rectangular pipe, said gasket forming on one side sealing abutments against at least one said section and the lower frame portion of the first type of section engaging at least one said section and on the opposite side a sealing abutment against a frame plate by way of an elastically yielding duct-containing portion as well as forming a support abutment against the upper end of a support profile adapted to be fixed to an outer wall just below the frame plate.

8. A construction according to claim 7, which includes first, second and third cooperating lower profile members, the first member forming a tensioning means and adapted to be adjustable in different positions along the second and third members, the second member forming a mounting on at least one said section which extends the whole of the length thereof enabling the first member to be clamped to the second member in different longitudinally displaced positions of the first type of section relative to the frame and the third member forming a locking means for the first member, said third member being fixed to and extending the whole of the length of the frame plate enabling the first type of section to be displaced in one or the other direction relative to the frame.

9. A construction according to claim 7, wherein a mounting engages the lower frame portion and is fixed to a sleeve arranged to pass through the wall and screw-threadedly engaging a member rotatably mounted at the inner wall, the arrangement being such that rotation of said member urges the section of the first type into sealing engagement with the gasket.

* * * * *